US011540356B2

(12) United States Patent
Huang

(10) Patent No.: US 11,540,356 B2
(45) Date of Patent: Dec. 27, 2022

(54) SAFE ELECTRIC BLANKET

(71) Applicant: GUANGDONG LAIJUN ELECTRONIC TECHNOLOGY CO., LTD., Dongguan (CN)

(72) Inventor: Wanglai Huang, Dongguan (CN)

(73) Assignee: GUANGDONG LAIJUN ELECTRONIC TECHNOLOGY CO., LTD., Dongguan (CN)

( * ) Notice: Subject to any disclaimer, the term of this patent is extended or adjusted under 35 U.S.C. 154(b) by 424 days.

(21) Appl. No.: 16/727,932

(22) Filed: Dec. 27, 2019

(65) Prior Publication Data

US 2021/0204364 A1 Jul. 1, 2021

(51) Int. Cl.
*H05B 1/02* (2006.01)
*H05B 3/34* (2006.01)

(52) U.S. Cl.
CPC ..... *H05B 1/0272* (2013.01); *H05B 3/342* (2013.01); *H05B 2203/011* (2013.01); *H05B 2203/014* (2013.01)

(58) Field of Classification Search
CPC ..... H05B 1/0272; H05B 3/342; H05B 2203/011; H05B 2203/014; H05B 3/36; H05B 3/00; H05B 1/02; H05B 3/34
USPC ..... 219/212, 213, 481, 528, 211, 529, 545, 219/497, 552
See application file for complete search history.

(56) References Cited

U.S. PATENT DOCUMENTS 7,019,262 B1 * 3/2006 Lu ..... H05B 1/0227 219/212
2004/0074897 A1 * 4/2004 Krieger ..... H05B 3/342 219/212
2007/0139844 A1 * 6/2007 Horey ..... H02H 3/08 361/104
2010/0321845 A1 * 12/2010 Imura ..... G05F 1/569 361/86

FOREIGN PATENT DOCUMENTS

CN 202331449 U * 7/2012
CN 104635798 A * 5/2015
CN 206313976 U * 7/2017

* cited by examiner

*Primary Examiner* — Tu B Hoang
*Assistant Examiner* — Yeong Juen Thong
(74) *Attorney, Agent, or Firm* — Leong C. Lei

(57) ABSTRACT

A safe electric blanket includes a main control circuit, a constant temperature circuit, a detection circuit, a heating wire, an overheat protection circuit for overheat detection and blowout, a power circuit for connecting mains electricity, and a fuse disposed between the mains electricity and the power circuit. The power circuit is connected to one end of the heating wire, the main control circuit, the detection circuit and the overheat protection circuit for supplying power. The main control circuit is connected to the detection circuit, the overheat protection circuit and the constant temperature circuit. The overheat protection circuit is connected to the fuse F1 for controlling the fuse F1 to blow. The constant temperature circuit is connected to another end of the heating wire for controlling a working state of the heating wire.

9 Claims, 2 Drawing Sheets

SAFE ELECTRIC BLANKET

BACKGROUND OF THE INVENTION

1. Field of the Invention

The present invention relates to an electric blanket, and more particularly to a safe electric blanket.

2. Description of the Prior Art

With the development of science and technology, people's living standards are improved, especially the environmental requirements for living and working, such as the requirements for heating supplies and electric blankets. An electric blanket is often used indoors. It can be used on the ground, on a chair, or on a bed.

The existing electric blankets have poor safety. Once the temperature is too high and the power cannot be turned off in time, it will endanger the user's safety and lead to a short service life of the electric blanket.

Accordingly, the inventor of the present invention has devoted himself based on his many years of practical experiences to solve these problems.

SUMMARY OF THE INVENTION

In view of the shortcomings of the prior art, the primary object of the present invention is to provide a safe electric blanket, which can automatically protect from overheat, improve the overall safety of the electric blanket, extend the service life of the electric blanket, ensure the user's safety and being able to detect local overheating of the electric blanket.

In order to achieve the above object, the present invention adopts the following technical solutions:

A safe electric blanket comprises a main control circuit, a constant temperature circuit, a detection circuit, a heating wire, an overheat protection circuit for overheat detection and blowout, a power circuit for connecting mains electricity, and a fuse disposed between the mains electricity and the power circuit. The power circuit is connected to one end of the heating wire, the main control circuit, the detection circuit and the overheat protection circuit for supplying power. The main control circuit is connected to the detection circuit, the overheat protection circuit and the constant temperature circuit. The overheat protection circuit is connected to the fuse F1 for controlling the fuse F1 to blow. The constant temperature circuit is connected to another end of the heating wire for controlling a working state of the heating wire.

Preferably, the main control circuit includes a main control chip U1. The main control chip U1 has main control pins 1-20. The main control pin 1 is connected to an analog ground. The main control pin 20 is connected to the analog ground through a capacitor C7. The power circuit is connected to the main control pin 19 and the main control pin 20. The main control pin 16 and the main control pin 17 are connected to the detection circuit. The main control pin 15 and the main control pin 18 are connected to the overheat protection circuit. The main control pin 13 is connected to the constant temperature circuit.

Compared with the prior art, the present invention has obvious advantages and beneficial effects. Specifically, it mainly detects the temperature of the electric blanket in real time through the detection circuit.

Once the temperature of the electric blanket exceeds the set maximum temperature, the main control circuit will control the overheat protection circuit to blow the fuse. This can automatically protect from overheat, improve the overall safety of the electric blanket, extend the service life of the electric blanket, and ensure the user's safety. In particular, through the overheat protection circuit, it is possible to detect local overheating of the electric blanket.

Secondly, through the display circuit and the function button circuit, the working status of the electric blanket can be clearly understood and adjusted, and the controllability is good.

Furthermore, the heating resistor is provided on one side of the fuse F1 or connected to the fuse F1.

When the temperature of the electric blanket exceeds the set maximum temperature, the main control circuit increases the current through the heating resistor, so that the heating resistor generates heat to blow the fuse F1. The fusing method is simple, the automatic fusing function is achieved, and the practicability is better. The overall circuit structure is clever and reasonable to ensure the stability and reliability of the electric blanket during use.

DETAILED DESCRIPTION OF THE PREFERRED EMBODIMENTS

Embodiments of the present invention will now be described, by way of example only, with reference to the accompanying drawings.

Figure 1:
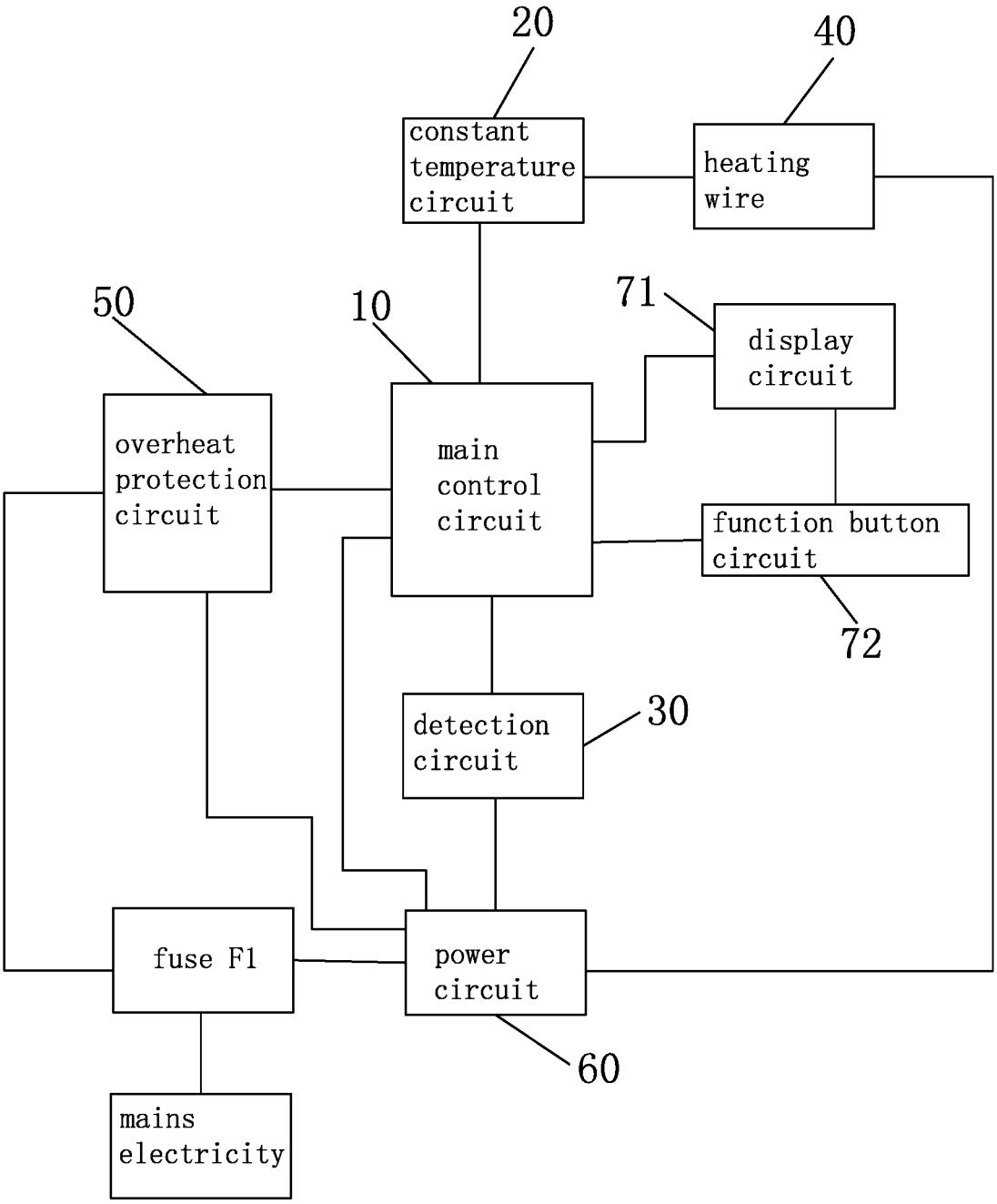
FIG. 1 is a block diagram showing the control principle of an embodiment of the present invention.
Figure 2:
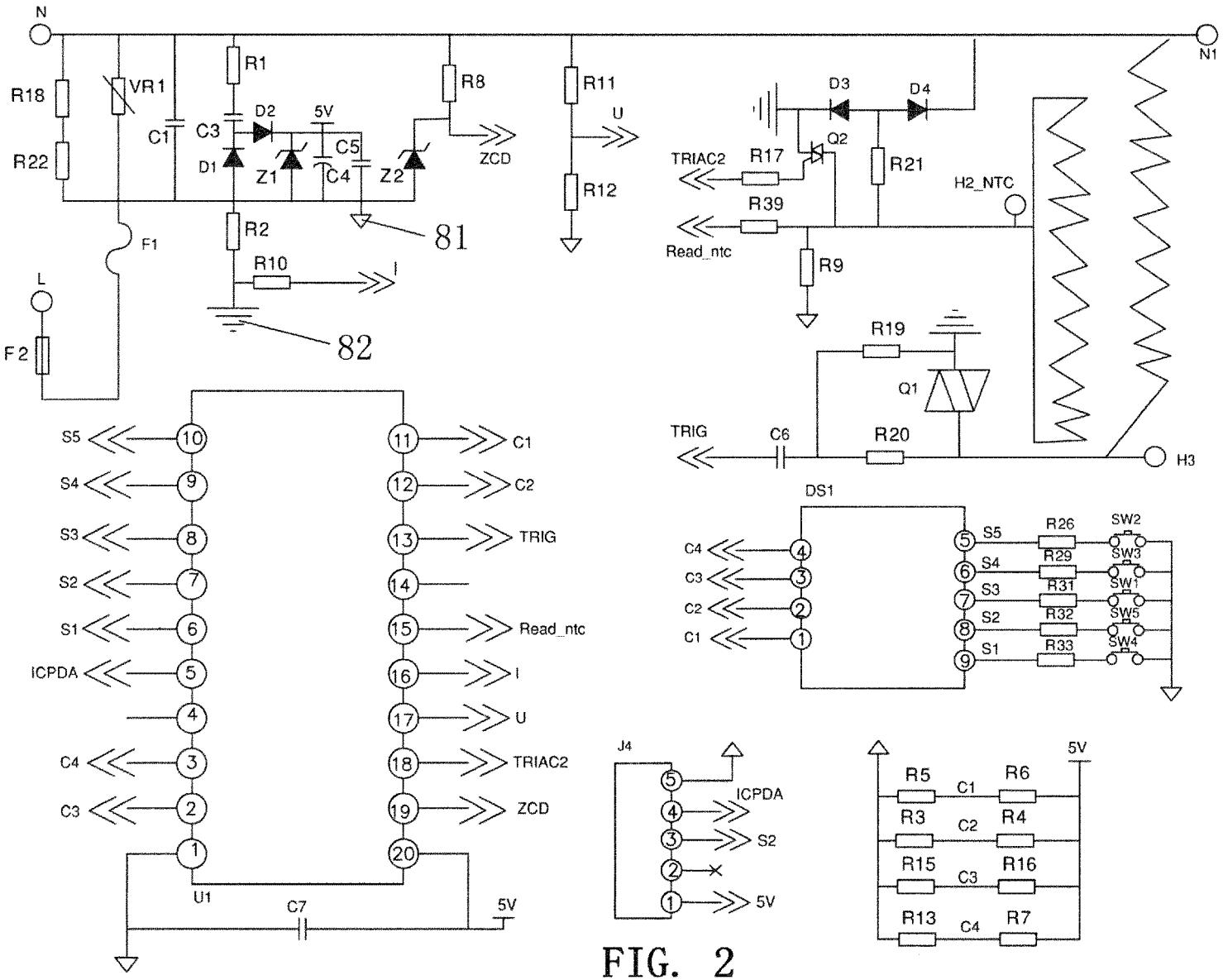
FIG. 2 is a schematic circuit diagram of an embodiment of the present invention.

As shown in FIG. 1 and FIG. 2, the present invention discloses a safe electric blanket, comprising a main control circuit 10, a constant temperature circuit 20, a detection circuit 30, a heating wire 40, an overheat protection circuit 50 for overheat detection and blowout, a power circuit 60 for connecting the mains electricity, and a fuse F1 disposed between the live wire of the mains electricity and the power circuit 60. One end of the fuse F1 is connected to the live wire, and the other end of the fuse F1 is connected to the analog ground 81.

The power circuit 60 is connected to one end of the heating wire 40, the main control circuit 10, the detection circuit 30, and the overheat protection circuit 50 for supplying power. In this embodiment, the power circuit 60 includes a varistor VR1, a resistor R1, a resistor R8, a resistor R18, a resistor R22, a capacitor C1, a capacitor C3, a polar capacitor C4, a capacitor C5, a diode D2, a diode D1, and a Zener diode Z1, and a Zener diode Z2. Wherein, the anode of the polar capacitor C4 outputs a voltage of 5V.

The main control circuit 10 is connected to the detection circuit 30, the overheat protection circuit 50, and the constant temperature circuit 20. The overheat protection circuit 50 is connected to the fuse F1 for controlling the fuse F1 to blow. The constant temperature circuit 20 is connected to the other end of the heating wire 40 for controlling the working state of the heating wire 40.

In this embodiment, the main control circuit 10 includes a main control chip U1. Preferably, the type of the main control chip U1 is HT66F018. The main control chip U1 has main control pins 1-20.

The main control pin 1 is connected to the analog ground 81. The main control pin 20 is connected to the analog ground 81 through capacitor C7. The power circuit 60 is connected to the main control pin 19 and the main control pin 20. Both the main control pin 16 and the main control pin 17 are connected to the detection circuit 30. Both the main control pin 15 and the main control pin 18 are connected to the overheat protection circuit 50. The main control pin 13 is connected to the constant temperature circuit 20.

In this embodiment, the detection circuit 30 includes a resistor R2, a resistor R10, a resistor R11, and a resistor R12. The resistor R11 has a first detection terminal and a second detection terminal for connecting the mains electricity. The first detection terminal is connected to the analog ground 81 through the resistor R12. The main control pin 17 of the main control circuit 10 is connected to the first detection terminal. Two ends of the resistor R2 are respectively connected to the analog ground 81 and the digital ground 82. The main control pin 16 of the main control circuit 10 is connected to the digital ground 82 through the resistor R10. The main control pin 17 and the main control pin 16 of the main control circuit 10 are configured to receive a signal (such as a current signal and a voltage signal) detected by the detection circuit 30. The main control circuit 10 calculates the real-time temperature of the heating wire 40 according to the signal and the characteristics of the heating wire 40. The main control circuit 10 monitors the temperature of the heating wire 40 in real time. When the temperature of the heating wire 40 is lower than the set temperature value, the constant temperature circuit 20 is controlled to increase the temperature of the heating wire 40. When the temperature of the heating wire 40 is higher than the set temperature value, the constant temperature circuit 20 is controlled to stop increasing the temperature of the heating wire 40. This is repeated to achieve a constant temperature.

The overheat protection circuit 50 includes a diode D4, a diode D3, a triode Q2, a resistor R21, a resistor R17, a resistor R39, a resistor R9, and a temperature detection unit.

The resistor R21 is a heating resistor. The heating resistor is disposed on one side of the fuse F1 so that the heat generated by the heating resistor can blow the fuse F1, or the heating resistor is closely connected to the fuse F1. If the temperature of the electric blanket exceeds the set maximum temperature or there is uncontrollable continuous heating, the main control pin 18 controls the triode Q2 to be turned on. At the same time, the main control pin 15 outputs a high current. The high current flows back to the null wire through the resistor R21 and the diode D4 in order. Because the resistor R21 is a heating resistor, the current increases, which causes the resistor R21 to generate high heat, and then the fuse F1 is blown to achieve an active fuse function and improve the safety of the user.

It should be noted that the detection circuit 30 in this embodiment can also monitor whether an uncontrollable electrical signal occurs in real time when the main control chip U1 is powered on but the user doesn't use the electric blanket (that is, the off state). If an uncontrollable electrical signal occurs, the main control circuit 10 will output a high current to the resistor R21. Because the resistor R21 is a heating resistor, the current increases, which causes the resistor R21 to generate high heat, and then the fuse F1 is blown to achieve an active fuse function and improve the safety of the user.

The diode D4 has a first anode and a first cathode for connecting the null wire of the mains electricity. The diode D3 has a second anode and a second cathode. The first anode and the second anode are commonly connected to the temperature detection unit through the resistor R21. The temperature detection unit is connected to the main control circuit 10 through the resistor R39. The main control pin 15 of the main control circuit 10 is also connected to the analog ground 81 through the resistor R9.

The second cathode is connected to the analog ground 81. The base of the transistor Q2 is connected to the analog ground 81. The emitter of the transistor Q2 is connected to the main control pin 18 of the main control circuit 10 through the resistor R17. The collector of the transistor Q2 is connected to the temperature detection unit. Preferably, the temperature detection unit is a thermistor. The temperature detection unit is configured to detect whether the electric blanket is partially folded for use. If local overheating is detected, the electric blanket is determined to be partially folded for use. At this time, the main control circuit 10 controls the constant temperature circuit 20 to temporarily stop heating the heating wire 40 through the main control pin 15. When the local overheating reaches the safe limit of the fuse F1, passive fuse will be started, that is, the temperature of the local overheating will reach the temperature at which the fuse is blown by itself.

The constant temperature circuit 20 includes a unidirectional thyristor Q1, a resistor R19, a resistor R20, and a capacitor C6. Preferably, the type of the unidirectional thyristor Q1 is BT134. The gate of the unidirectional thyristor Q1 is connected to the main control pin 13 of the main control circuit 10 through the resistor R20 and the capacitor C6. The T1 electrode of the unidirectional thyristor Q1 is connected to the digital ground 82. The T1 electrode of the thyristor Q1 is further connected to the gate of the unidirectional thyristor Q1 through the resistor R19 and the resistor R20. The T2 electrode of the unidirectional thyristor Q1 is connected to the other end of the heating wire 40. The main control circuit 10 controls the constant temperature circuit 20 to heat the heating wire 40 through the main control pin 15.

The safe electric blanket of the present invention further comprises a display circuit 71. The display circuit 71 can display the temperature and timing time. The display circuit 71 includes a display chip LCD1, a resistor R13, a resistor R15, a resistor R16, and resistors R3 to R7. The display chip LCD1 has display pins 1 to 9.

The main control pin 11 is connected to the display pin 1. The display pin 1 is connected to the analog ground 81 through the resistor R5, and the display pin 1 is connected to the power circuit 60 through the resistor R6. The main control pin 12 is connected to the display pin 2. The display pin 2 is connected to the analog ground 81 through the resistor R3, and the display pin 1 is connected to the power circuit 60 through the resistor R4. The main control pin 2 is connected to the display pin 3. The display pin 3 is connected to the analog ground 81 through the resistor R15, and the display pin 1 is connected to the power circuit 60 through the resistor R16. The main control pin 3 is connected to the display pin 4. The display pin 4 is connected to the analog ground 81 through the resistor R13, and the display pin 1 is connected to the power circuit 60 through the resistor R7.

The safe electric blanket of the present invention further comprises a function button circuit 72. Through the function button circuit 72, it is possible to realize the power on/off, the adjustment of the temperature range and the timing time. The function button circuit 72 includes a power button SW1, a warm increase button SW2, a warm decrease button SW3, a first timing adjustment button SW4, a second timing adjustment button SW5, a resistor R26, a resistor R29, and resistors R31 to R33.

One end of the power button SW1 is connected to the display pin 7 through the resistor R31. The main control pin 8 is connected to the display pin 7. One end of the warm increase button SW2 is connected to the display pin 5 through the resistor R26, and the main control pin 10 is connected to the display pin 5. One end of the warm decrease button SW3 is connected to the display pin 6 through the resistor R29, and the main control pin 9 is connected to the display pin 6. One end of the first timing adjustment button SW4 is connected to the display pin 9 through the resistor R33, and the main control pin 6 is connected to the display pin 9. One end of the second timing adjustment button SW5 is connected to the display pin 8 through the resistor R32, and the main control pin 7 is connected to the display pin 8. The other end of the power button SW1, the other end of the warm increase button SW2, the other end of the warm decrease button SW3, the other end of the first timing adjustment button SW4 and the other end of the second timing adjustment button SW5 are all connected to the analog ground 81.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A safe electric blanket, comprising a main control circuit, a constant temperature circuit, a detection circuit, a heating wire, an overheat protection circuit for overheat detection and blowout, a power circuit for connecting mains electricity, and a fuse (F1) disposed between the mains electricity and the power circuit;

the power circuit being connected to one end of the heating wire, the main control circuit, the detection circuit and the overheat protection circuit for supplying power;

the main control circuit being connected to the detection circuit, the overheat protection circuit and the constant temperature circuit, the overheat protection circuit being connected to the fuse (F1) for controlling the fuse (F1) to blow, the constant temperature circuit being connected to another end of the heating wire for controlling a working state of the heating wire, wherein the overheat protection circuit includes a diode (D4), a diode (D3), a transistor (Q2), a resistor (R21), a resistor (R17), a resistor (R39), a resistor (R9), and a temperature detection unit;

the diode (D4) has a first anode and a first cathode for connecting a null wire of the mains electricity, the diode (D3) has a second anode and a second cathode, the first anode and the second anode are commonly connected to the temperature detection unit through the resistor (R21), the temperature detection unit is connected to the main control circuit through the resistor (R39), the main control circuit is connected to an analog ground through the resistor (R9);

the second cathode is connected to the analog ground, a base of the transistor (Q2) is connected to the analog ground, an emitter of the transistor (Q2) is connected to the main control circuit through the resistor (R17), and a collector of the transistor (Q2) is connected to the temperature detection unit, and wherein the main control circuit is operable to selectively conduct on the transistor (Q2) in response to a signal of temperature abnormality so as to feed a high current that flow, in sequence, through the resistor (21) and the diode (D4) to a null line, wherein the resistor (21) is a heat generation resistor that, through the high current flowing therethrough, generates a high heat that blows the fuse (F1).

2. The safe electric blanket as claimed in claim 1, wherein the main control circuit includes a main control chip (U1), the main control chip (U1) has main control pins (1-20);

the main control pin (1) is connected to an analog ground, the main control pin (20) is connected to the analog ground through a capacitor (C7), the power circuit is connected to the main control pin (19) and the main control pin (20), the main control pin (16) and the main control pin (17) are connected to the detection circuit, the main control pin (15) and the main control pin (18) are connected to the overheat protection circuit, the main control pin (13) is connected to the constant temperature circuit.

3. The safe electric blanket as claimed in claim 1, wherein the detection circuit includes a resistor (R2), a resistor (R10), a resistor (R11) and a resistor (R12), the resistor (R11) has a first detection terminal and a second detection terminal for connecting the mains electricity, the first detection terminal is connected to an analog ground through the resistor (R12), the main control circuit is connected to the first detection terminal; two ends of the resistor (R2) are respectively connected to the analog ground and a digital ground, and the main control circuit is connected to the digital ground through the resistor (R10).

4. The safe electric blanket as claimed in claim 1, wherein the temperature detection unit is a thermistor.

5. The safe electric blanket as claimed in claim 1, wherein the resistor (R21) is a heating resistor, and the heating resistor is disposed on one side of the fuse (F1) so that heat generated by the heating resistor can blow the fuse (F1).

6. The safe electric blanket as claimed in claim 1, wherein the resistor (R21) is a heating resistor, and the heating resistor is closely connected to the fuse (F1).

7. The safe electric blanket as claimed in claim 1, wherein the constant temperature circuit includes a unidirectional thyristor (Q1), a resistor (R19), a resistor (R20), and a capacitor (C6);

a gate of the unidirectional thyristor (Q1) is connected to the main control circuit through the resistor (R20) and the capacitor (C6), a first electrode (T1) of the unidirectional thyristor (Q1) is connected to a digital ground, the first electrode (T1) of the thyristor (Q1) is further connected to the gate of the unidirectional thyristor (Q1) through the resistor (R19) and the resistor (R20), and a second electrode (T2) of the unidirectional thyristor (Q1) is connected to the another end of the heating wire.

8. The safe electric blanket as claimed in claim 2, further comprising a display circuit, the display circuit including a display chip (LCD1), a resistor (R13), a resistor (R15), a resistor (R16) and resistors (R3) to (R7), the display chip (LCD1) having display pins (1) to (9);

the main control pin (11) being connected to the display pin (1), the display pin (1) being connected to the analog ground through the resistor (R5), the display pin (1) being connected to the power circuit through the resistor (R6);

the main control pin (12) being connected to the display pin (2), the display pin (2) being connected to the analog ground through the resistor (R3), the display pin (1) being connected to the power circuit through the resistor (R4);

the main control pin (2) being connected to the display pin (3), the display pin (3) being connected to the analog ground through the resistor (R15), the display pin (1) being connected to the power circuit through the resistor (R16);

the main control pin (3) being connected to the display pin (4), the display pin (4) being connected to the analog ground through the resistor (R13), the display pin (1) being connected to the power circuit through the resistor (R7).

9. The safe electric blanket as claimed in claim 8, further comprising a function button circuit, the function button circuit including a power button (SW1), a warm increase button (SW2), a warm decrease button (SW3), a first timing adjustment button (SW4), a second timing adjustment button (SW5), a resistor (R26), a resistor (R29), and resistors (R31) to (R33);

one end of the power button (SW1) being connected to the display pin (7) through the resistor (R31), the main control pin (8) being connected to the display pin (7); one end of the warm increase button (SW2) being connected to the display pin (5) through the resistor (R26), the main control pin (10) being connected to the display pin (5); one end of the warm decrease button (SW3) being connected to the display pin (6) through the resistor (R29), the main control pin (9) being connected to the display pin (6); one end of the first timing adjustment button (SW4) being connected to the display pin (9) through the resistor (R33), the main control pin (6) being connected to the display pin (9); one end of the second timing adjustment button (SW5) being connected to the display pin (8) through the resistor (R32), the main control pin (7) being connected to the display pin (8);

another end of the power button (SW1), another end of the warm increase button (SW2), another end of the warm decrease button (SW3), another end of the first timing adjustment button (SW4) and another end of the second timing adjustment button (SW5) are all connected to the analog ground.

* * * * *